US005332336A

United States Patent [19]

Lewis

[11] Patent Number: 5,332,336

[45] Date of Patent: Jul. 26, 1994

[54] OFFSHORE BASE-SUPPORTED COLUMN STRUCTURE AND METHOD OF INSTALLATION

[75] Inventor: Roger E. Lewis, Houston, Tex.

[73] Assignee: Kvaerner Earl And Wright, Inc., Houston, Tex.

[21] Appl. No.: 976,731

[22] Filed: Nov. 16, 1992

[51] Int. Cl.[5] ..... E02B 17/00

[52] U.S. Cl. ..... 405/204; 405/195.1; 405/224

[58] Field of Search ..... 405/204, 203, 202, 195.1; 248/163.1; 175/5-7

[56] References Cited

U.S. PATENT DOCUMENTS

| | | | |
|---|---|---|---|
| 2,802,635 | 8/1957 | Engelbart | 248/163.1 X |
| 3,379,245 | 4/1968 | Manning . | |
| 4,553,878 | 11/1985 | Willemse et al. | 405/203 |
| 4,558,973 | 12/1985 | Blandford | 405/216 |
| 4,679,964 | 7/1987 | Blandford | 405/216 |
| 4,740,107 | 4/1988 | Casbarian et al. | 405/204 X |
| 4,812,080 | 3/1989 | Urquhart | 405/227 |
| 4,824,291 | 4/1989 | Coppens | 405/204 |
| 4,917,541 | 4/1990 | Carruba | 405/227 |
| 4,966,496 | 10/1990 | Stelzer | 405/204 X |
| 4,983,074 | 1/1991 | Carruba | 405/227 |
| 5,042,960 | 8/1991 | Tawfik | 405/227 |
| 5,094,568 | 3/1992 | Carruba | 405/227 |
| 5,122,010 | 6/1992 | Burguieres et al. | 405/204 |

FOREIGN PATENT DOCUMENTS

| | | |
|---|---|---|
| 2096673 | 10/1982 | United Kingdom . |
| 2116237 | 9/1983 | United Kingdom . |
| 2122711 | 1/1984 | United Kingdom . |
| 2136482 | 9/1984 | United Kingdom . |
| 2136860 | 9/1984 | United Kingdom . |
| 2136909 | 9/1984 | United Kingdom . |
| 2200937 | 8/1988 | United Kingdom . |

*Primary Examiner*—Dennis L. Taylor
*Attorney, Agent, or Firm*—Fulbright & Jaworski

[57] ABSTRACT

An offshore base-supported column structure for installation in the water on an offshore floor having an elongate column vertically supported entirely from a column foundation on the offshore floor and releasably engaged to the foundation with the top of the column extending above the offshore water level. A column support base is supported from the offshore floor and engages and provides lateral support for the column with a slidable connection. A support structure is connected to the top of the column above the water level.

15 Claims, 18 Drawing Sheets

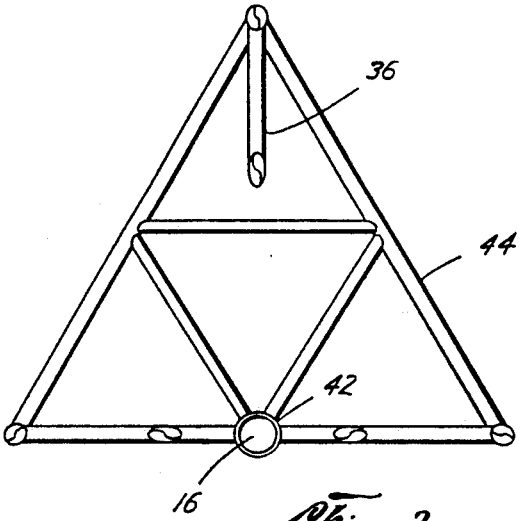
Fig. 3
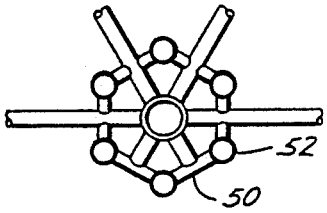
Fig. 5
Fig. 4
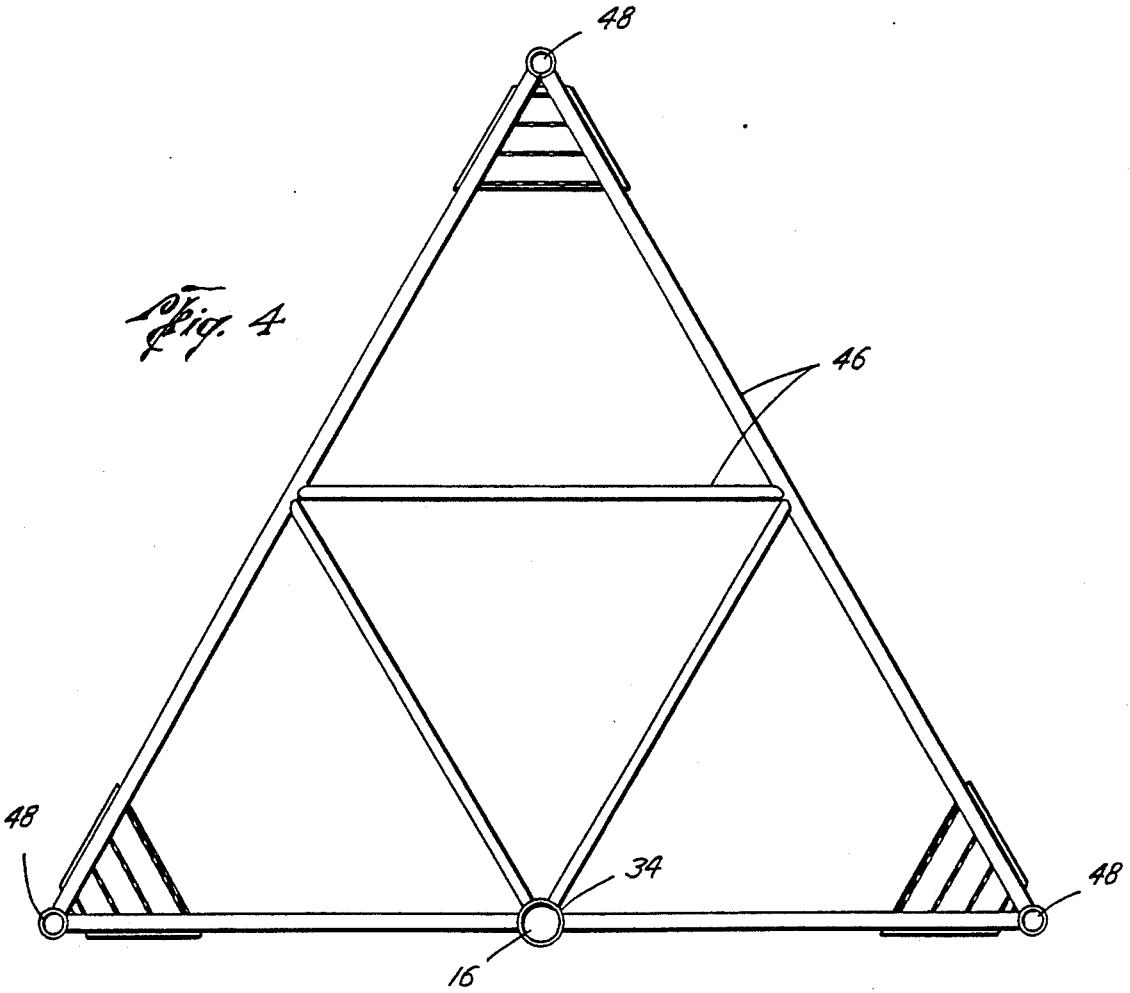

Fig. 9
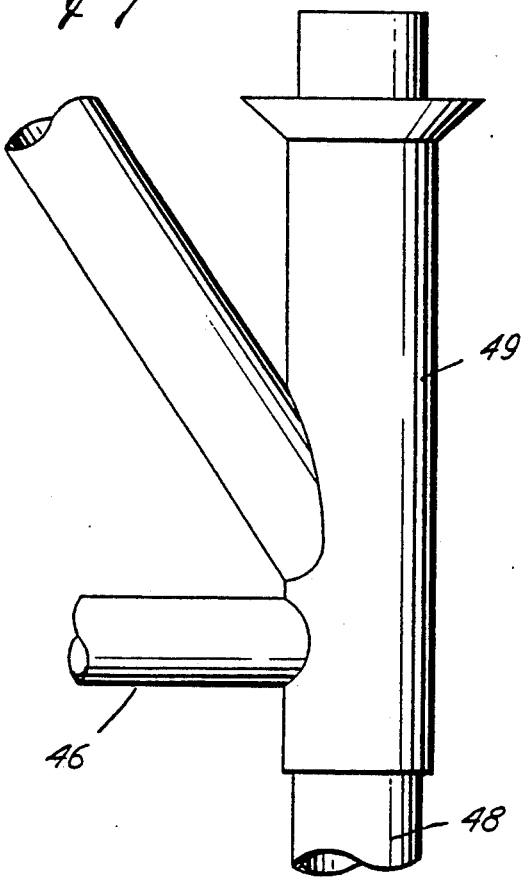
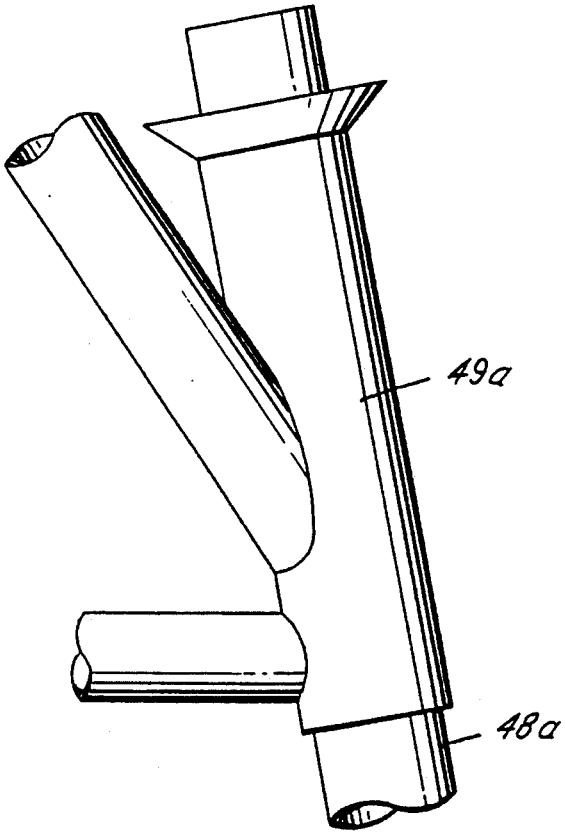
Fig. 10
Fig. 11
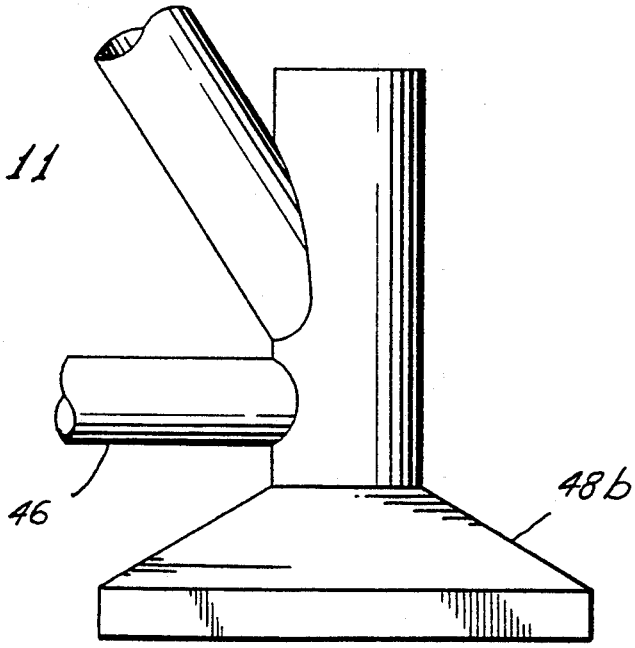

16
14
14
15
15

Fig. 25
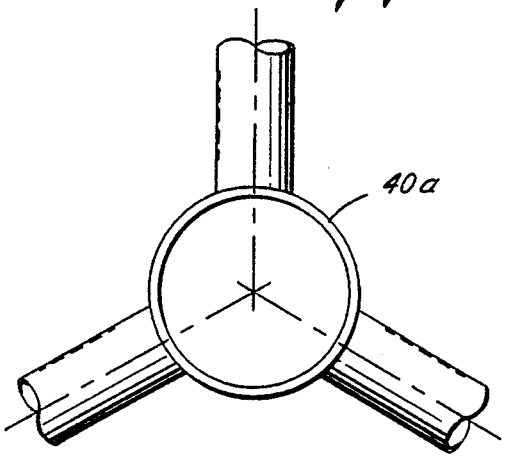
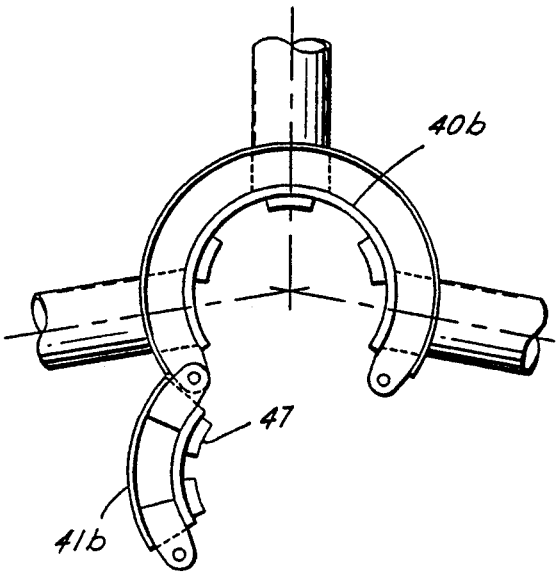
Fig. 26
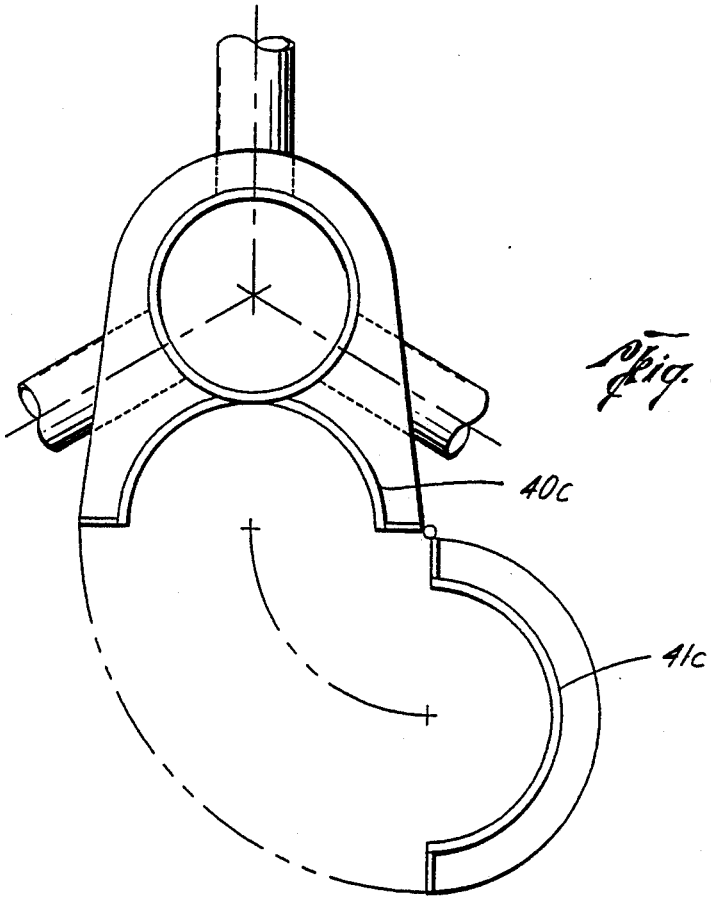
Fig. 27

Fig. 28
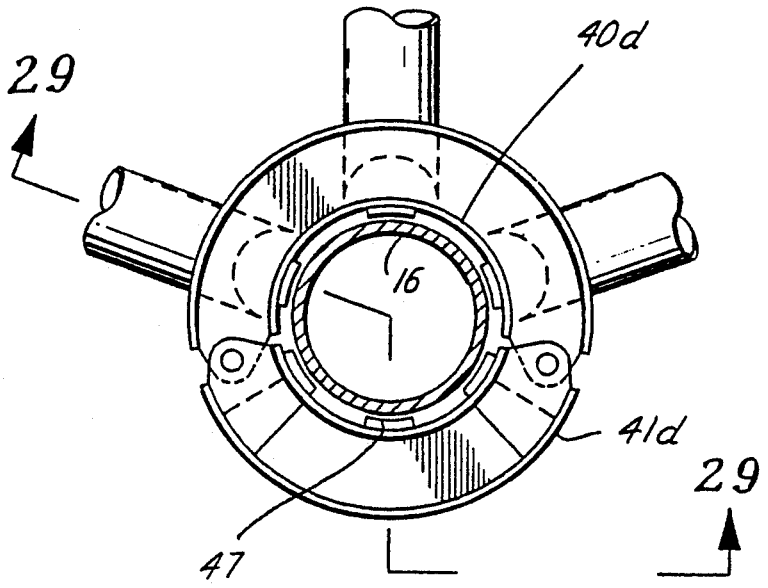
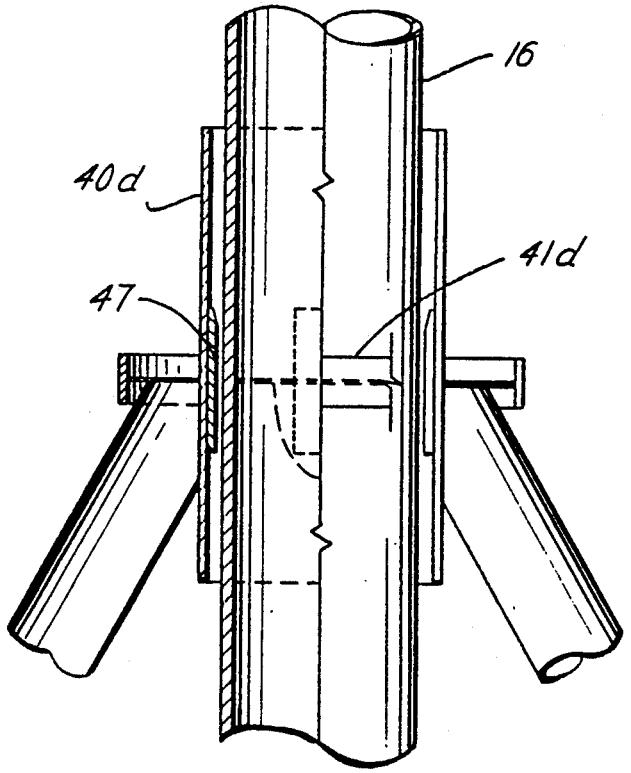
Fig. 29

Fig. 30
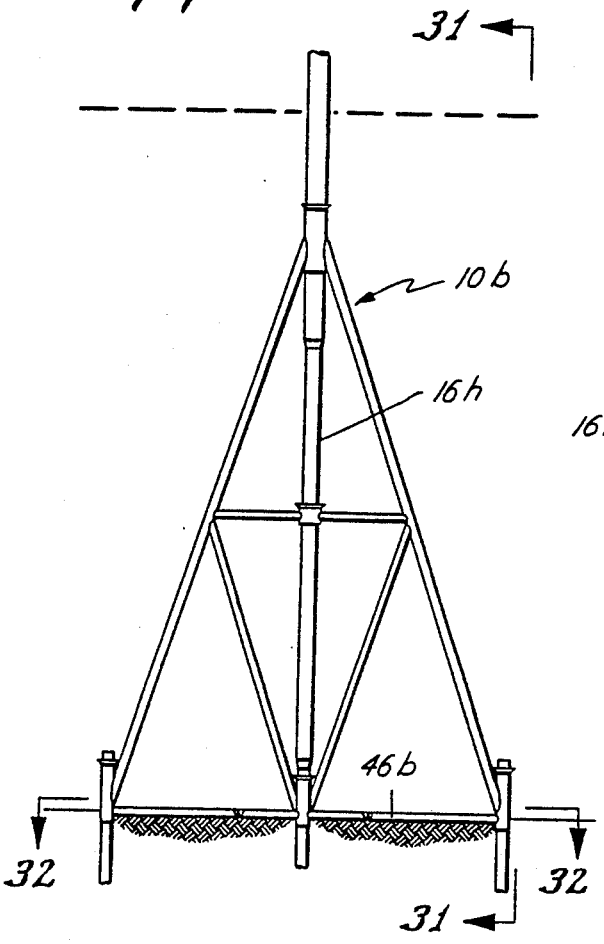
Fig. 31
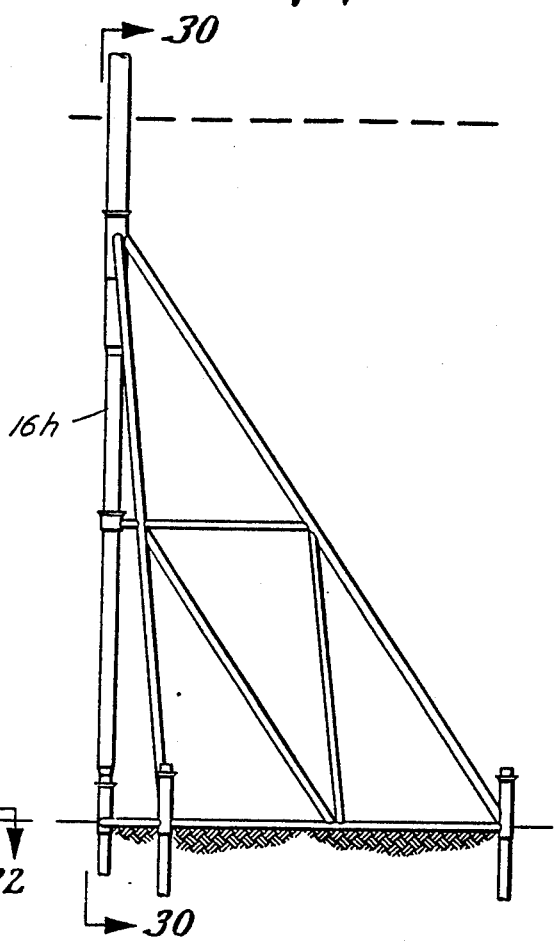
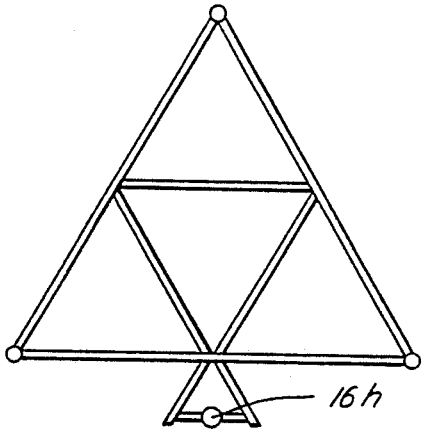
Fig. 32

Fig. 33
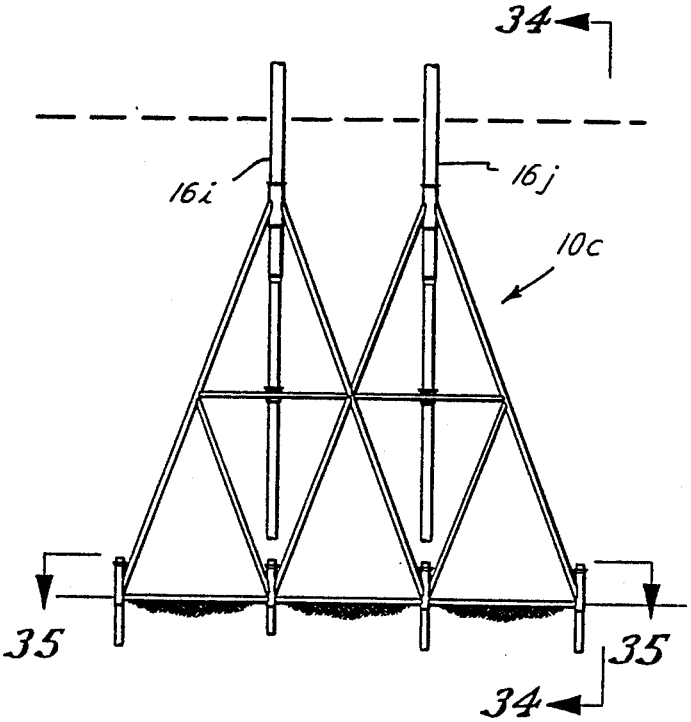
Fig. 34
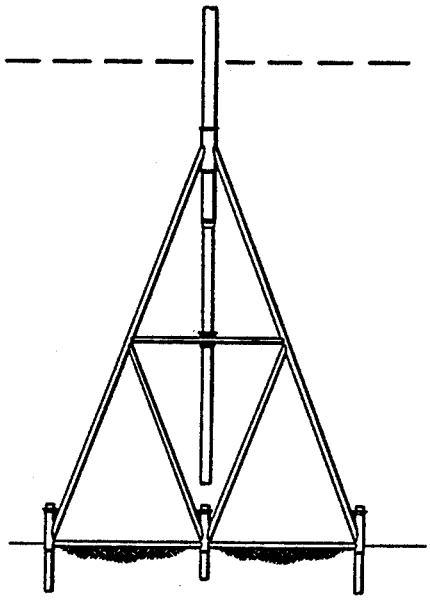
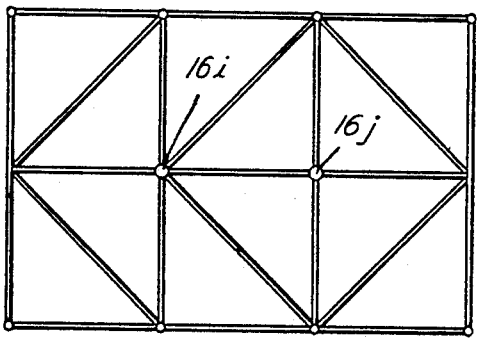
Fig. 35

Fig. 36
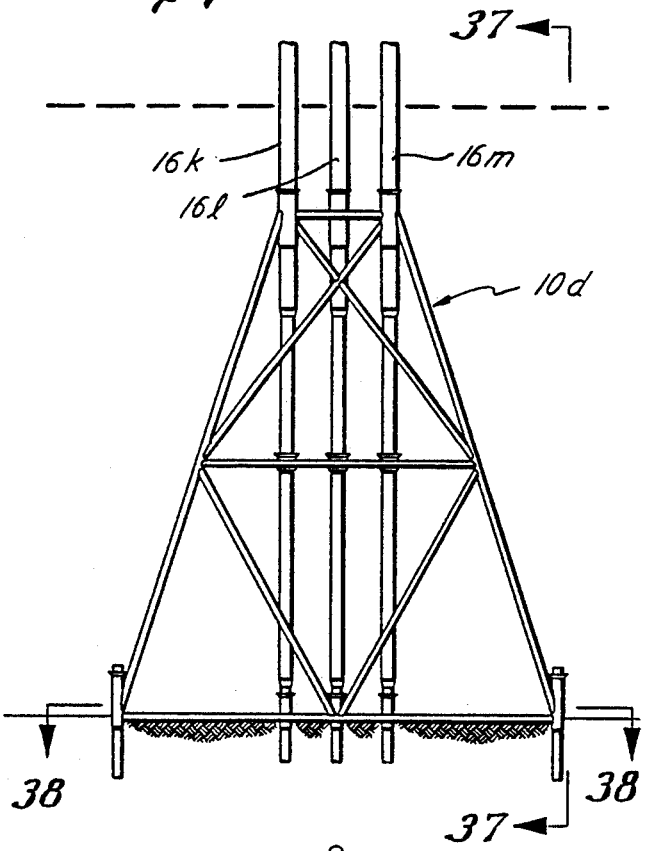
Fig. 37
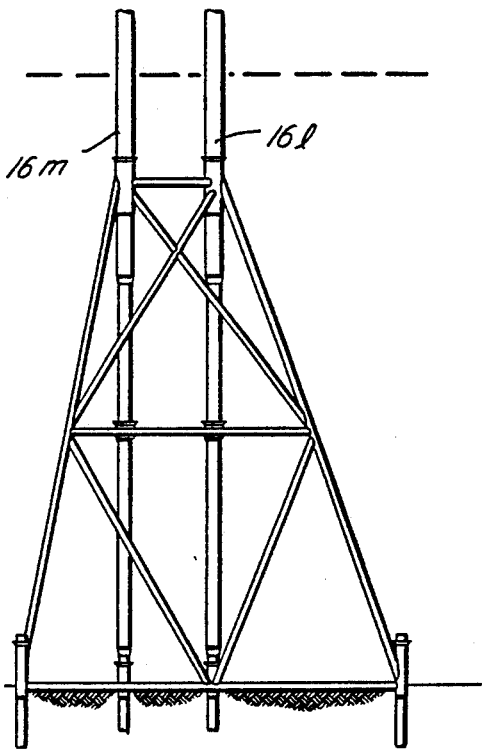
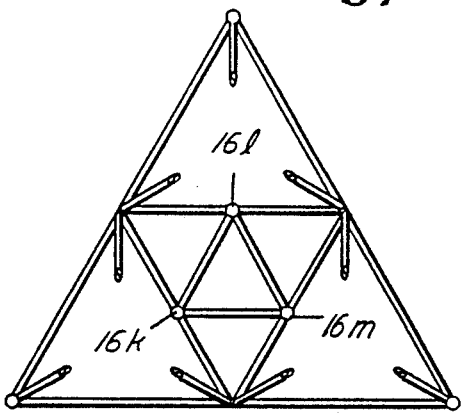
Fig. 38

OFFSHORE BASE-SUPPORTED COLUMN STRUCTURE AND METHOD OF INSTALLATION

BACKGROUND OF THE INVENTION

The present invention is directed to an improved light weight offshore structure having one or more elongate columns which can be used to hold a support structure, such as an equipment deck for such applications as the drilling and/or production of hydrocarbons, gas flaring, offshore loading, communication links, radar tracking, navigational aids, bridge supports, the mooring of vessels, etc. The column(s) are installed offshore in one or more pieces into a column support base which provides lateral support for the column(s). Vertical support for the column(s) is provided entirely by a column foundation.

Relative light weight structures such as tripods and minimum offshore support structures have been developed over recent years for supporting equipment used in the exploitation of marginal oil fields. Nevertheless, these structures are still heavier and more costly than need be. Because of the nature of their framing they are inefficient, are limited in the amount of equipment they can support, are limited in the water depths in which they can be used, are not suitable for drilling and/or production templates, are heavily dependent upon diver operations, and are not suited for relocation or reuse without extensive modification.

SUMMARY

It is an object of this invention to provide an offshore structure that (1) is light weight, (2) has a relatively high deck load capacity, (3) is suitable for use in a large range of water depths, (4) is adaptable for the pre-drilling and completion of wells, (5) can be fabricated in a relatively short period of time, (6) is capable of being installed with conventional lifting and/or drilling equipment, and (7) can be easily relocated for reuse at another offshore site with a water depth greatly different from the first site.

Still a further object of the present invention is the provision of an offshore base-supported column structure for installation in the water on an offshore floor. The structure includes a column foundation supported from the offshore floor, and a elongate column having a top and a foot. The foot contacts and is vertically supported entirely from the column foundation and the foot is releasably engaged with the foundation. The top extends upwardly above the offshore water level. A column support base is supported from the offshore floor for engaging and providing lateral support for the column. The column support base includes a structural framework extending upwardly from the offshore floor to an intermediate portion of the column, preferably below the water level. The base slidably engages the column in the vertical direction at the top of the base providing a column support against lateral movement. A support structure is connected to the top of the column above the water level.

Still a further object of the present invention is the provision of a column foundation guide connected to the column support base for receiving and guiding the column foundation.

Still a further object is the provision of a releasable connection between the foot and the foundation for transferring column axial and shear loads from the column to the foundation.

Still a further object of the present invention is the provision of one or more intermediate column supports connected to the column support base and slidably engaging the column for providing additional lateral support.

A further object is the provision of various embodiments of a column support which may include an enclosed sleeve, or a hinged clamp, or an open sided sleeve for receiving the column for releasably locking the column in place.

Yet a further object of the present invention is the provision of a bearing ring between the column and the column support.

Yet a further object is wherein the column support base includes a triangular base and the column extends through one side of the base.

Yet a further object of the present invention is wherein the structure includes a plurality of columns each of which is releasably supported from a column foundation and all of the columns freely extend vertically through and are laterally supported by the column support base.

A further object is wherein the column support base includes a mud line bracing system and the column extends vertically outside of the mud line bracing system.

Yet a further object of the present invention is the provision of a method of setting an offshore base-supported column structure which includes setting a column support base having a column support on the offshore floor with the column support positioned at the top of the base and above the ocean floor, anchoring the base to the floor, installing a column foundation in the offshore floor below the column support, installing the column by releasably engaging the bottom of the column with the column foundation and extending the top of the column above the offshore water level and providing the entire vertical support of the column from the foundation. The method further includes laterally supporting the column by the column support without providing vertical support and installing a support structure to the top of the column above the water level.

Still a further object is the method of installing the structure including guiding the installation of the column foundation through guides attached to the column support base. The method further includes slidably installing the column through the column support.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 3 is a cross-sectional view taken along the line 3—3 of FIG. 2, FIG. 4 is a cross-sectional view taken along the line 4—4 of FIG. 2, FIG. 5 is a fragmentary plan view illustrating a drilling template that may be utilized with the structure of FIGS. 1-4, FIG. 9 is an enlarged fragmentary elevational view of one type of column support base anchor system, FIG. 10 is an enlarged fragmentary elevational view of an alternate column support base anchor system, FIG. 11 is an enlarged fragmentary elevational view of still a further column support base anchor system.

FIG. 25 is an enlarged fragmentary plan view of one type of column support,

FIG. 26 is an enlarged fragmentary plan view of another embodiment of a column support, FIG. 27 is an enlarged fragmentary plan view of still a further embodiment of a column support, FIG. 28 is a cross-sectional view of a column installed in the column support of FIG. 26, FIG. 29 is a cross-sectional view taken along the line 29—29 of FIG. 28, FIG. 30 is a fragmentary elevational view of still a further embodiment of an offshore structure of the present invention, FIG. 31 is a view taken along the line 31—31 of FIG. 30, FIG. 32 is a cross-sectional view taken along the line 32—32 of FIG. 30, FIG. 33 is a fragmentary elevational view of still a further embodiment of an offshore structure of the present invention utilizing multiple columns, FIG. 34 is a view taken along the line 34—34 of FIG. 33, FIG. 35 is a cross-sectional view taken along the line 35—35 of FIG. 33, FIG. 36 is an elevational view of still a further embodiment of an offshore structure of the present invention utilizing multiple columns, FIG. 37 is a view taken along the line 37—37 of FIG. 36, FIG. 38 is a cross-sectional view taken along the line 38—38 of FIG. 36.

DESCRIPTION OF THE PREFERRED EMBODIMENT

Figure 1:
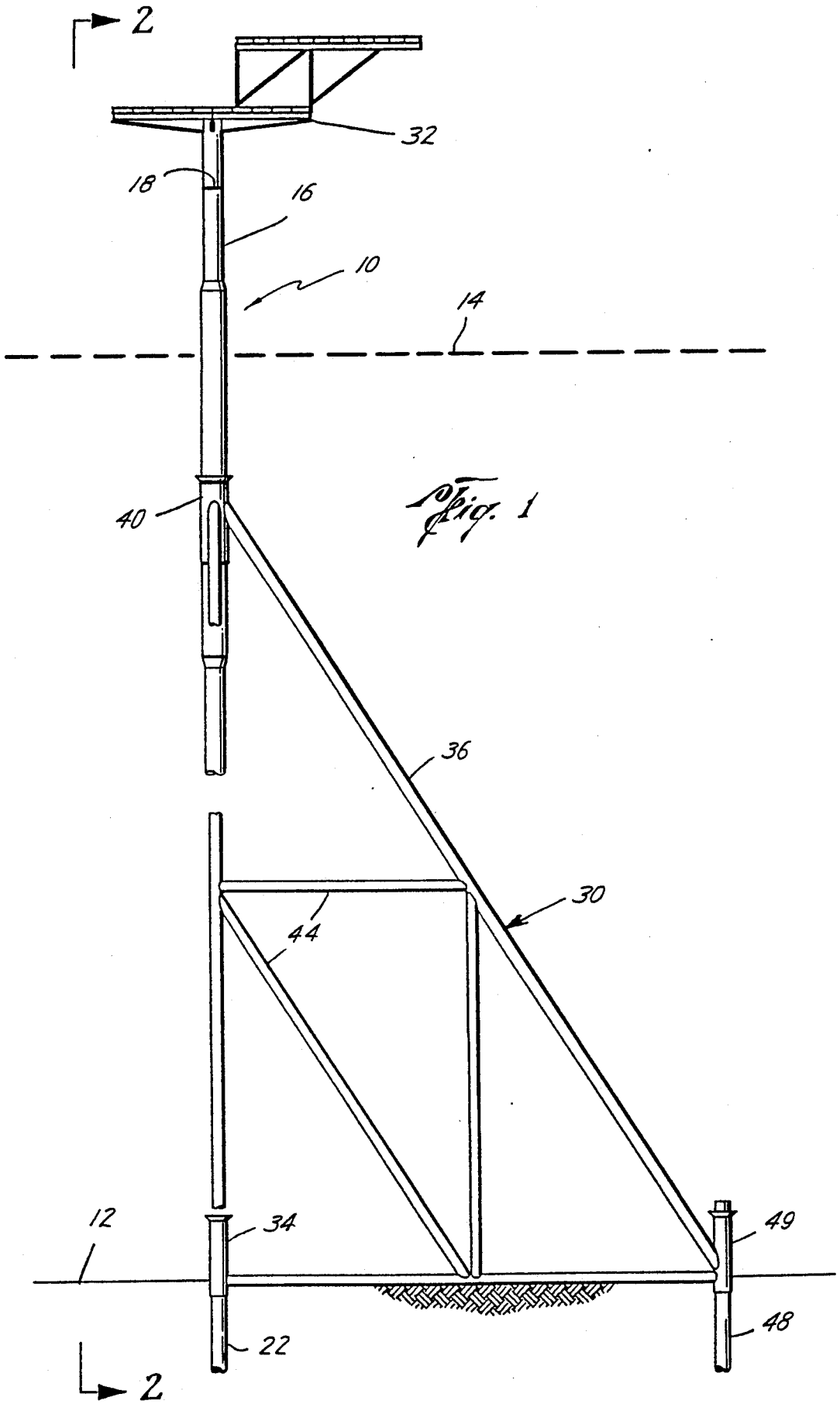
FIG. 1 is an elevational view, partly in section, illustrating one embodiment of the present invention.
Figure 2:
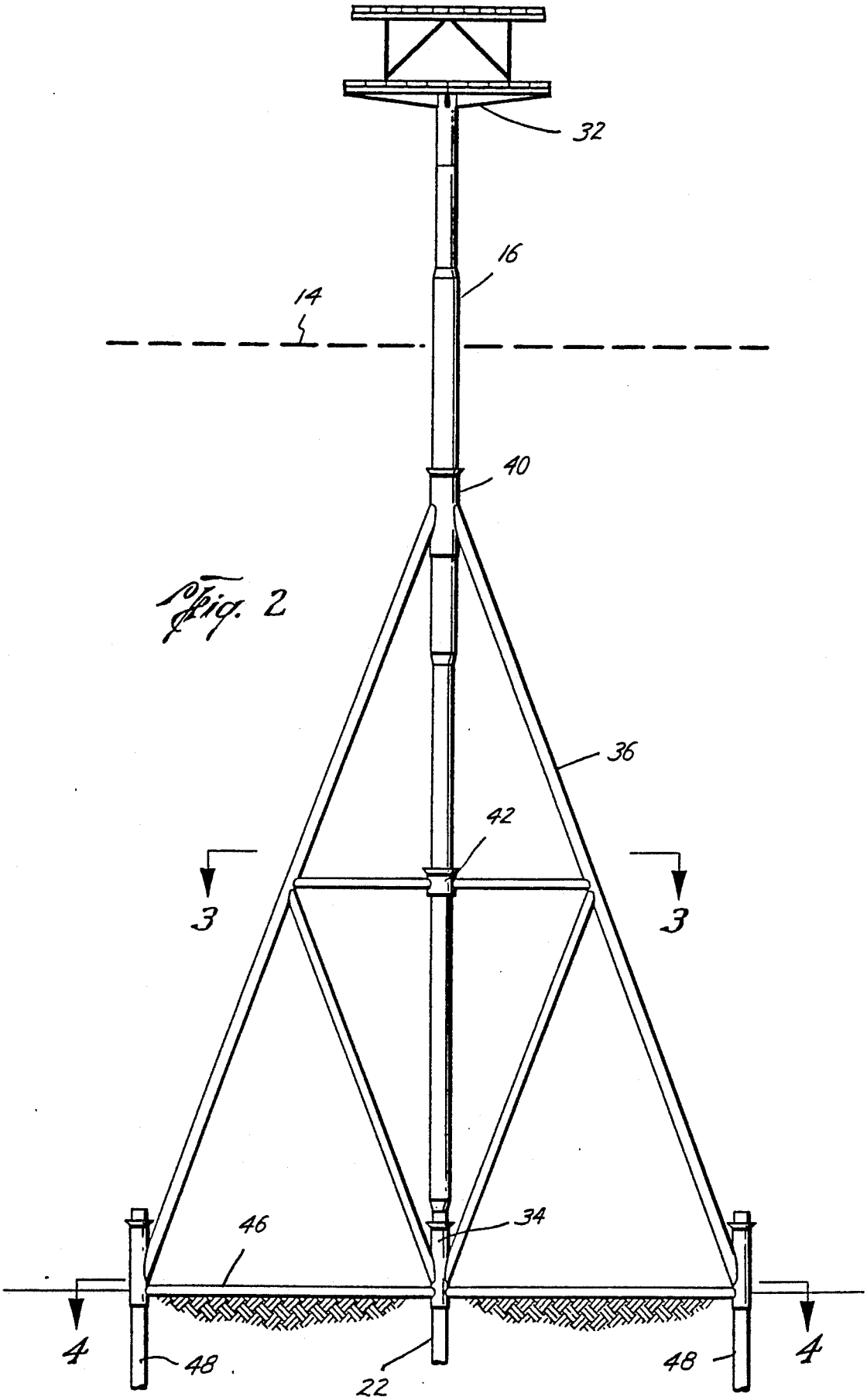
FIG. 2 is a view taken along the line 2—2 of FIG. 1.

Referring now to the drawings, particularly to FIGS. 1-11, the reference numeral 10 generally indicates the offshore base-supported column structure of the present invention for use in an offshore location having a mud line or offshore floor 12 and a water line 14. The structure 10 generally includes an elongate column 16 providing vertical support, a column foundation 22, a column support base 30 which provides the lateral support for the column 16, and a support structure 32.

The column foundation 22 provides the vertical support for the column 16. Preferably, the column foundation consists of a single pile 22 installed through a guide 34 which is attached to the column support base 30. Of course, other embodiments may be provided such as multiple pile arrangement or a gravity base. The guide 34 is preferably a sleeve for receiving and guiding the foundation 22 as it is driven or drilled into the offshore floor 12 after the column support base 30 has been set and anchored as will be more fully described hereinafter.

The column 16 is the principal supporting element of the offshore structure 10 and typically will consist of a hollow prismatic tubular steel member (as seen in FIGS. 17-22) having a foot 20 and a top 18. However, the material and cross-section may vary to suit specific conditions. The foot 20 is adapted to be releasably engaged and supported from the foundation 22 and the top 18 extends upwardly above the offshore water level 14.

Figure 17:
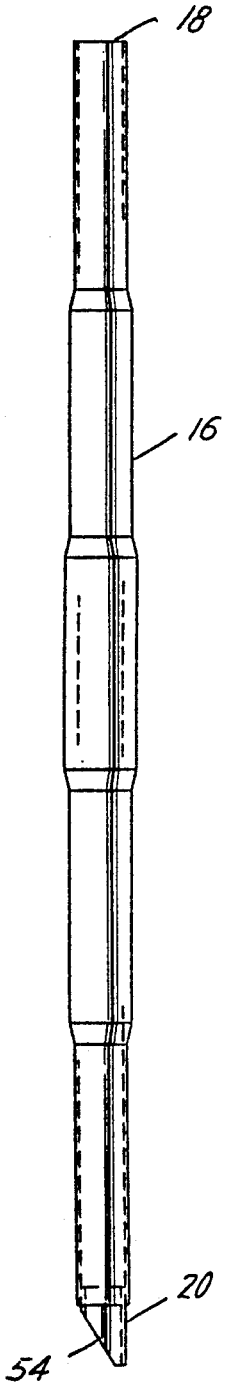
FIG. 17 is an elevational view of one embodiment of a column and foot.
Figure 18:
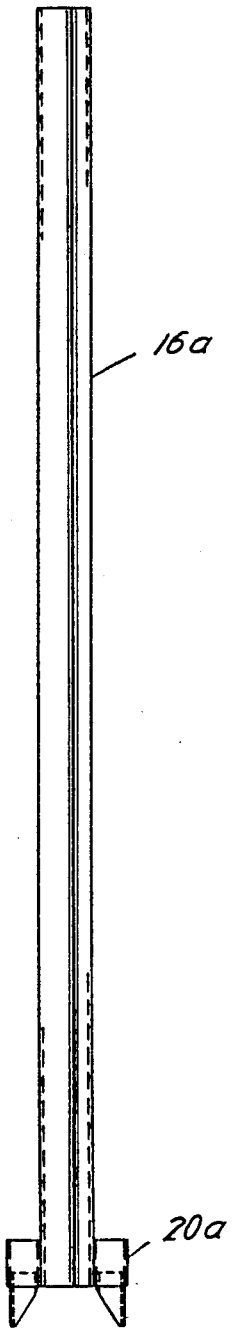
FIG. 18 is an elevational view of another embodiment of a column and a foot.
Figure 19:
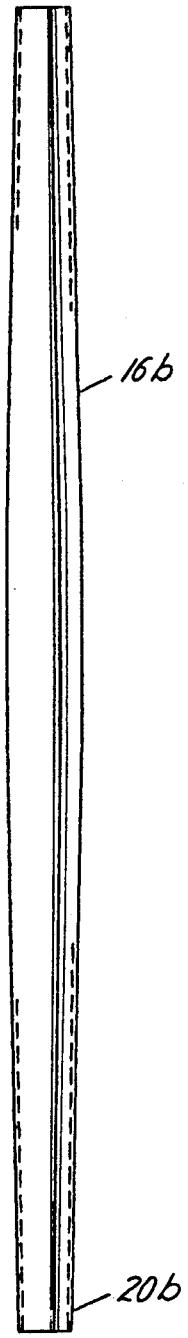
FIG. 19 is an elevational view of yet another embodiment of column and a foot.
Figure 20:
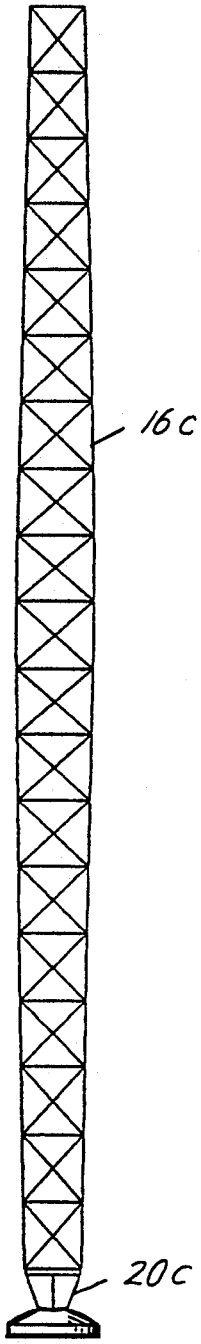
FIG. 20 is an elevational view of still another embodiment of a column and a foot.
Figure 21:
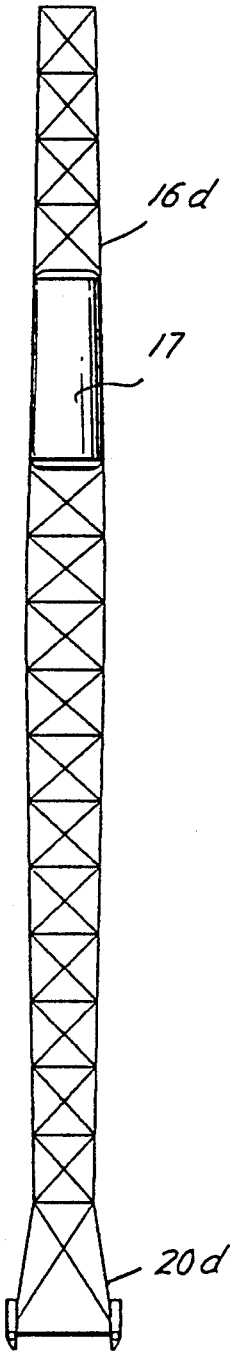
FIG. 21 is an elevational view of yet another embodiment of a column and a foot.
Figure 22:
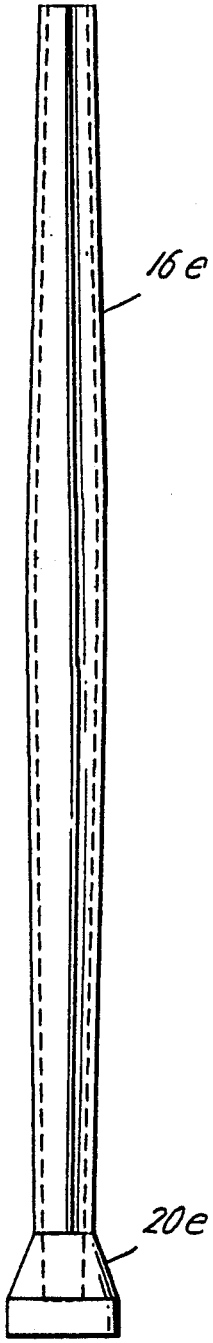
FIG. 22 is an elevational view of still a further embodiment of a column and a foot.

Referring to FIG. 17 the column 16, in the preferred embodiment, is a varying diameter steel tubular having a foot 20 of a stab-in type. Other and various embodiments may be used wherein FIG. 18 shows a constant diameter steel tubular column 16*a* with a foot 20*a* of a multiple stab-in type, FIG. 19 illustrates a tapered steel tubular column 16*b* having a right aligned foot 20*b* consisting simply of a prepared bearing surface, FIG. 20 illustrates a latticed constructed column 16*c* with a foot 20*c* of an articulated type, FIG. 21 illustrates a column 16*d* of a lattice construction having an auxiliary buoyancy chamber 17 and a foot 20*d* with a multiple stab-in type foot, and FIG. 22 illustrates a tapered concrete column 16*e* having a foot 20*e* of a gravity type.

The column 16 may be buoyant or non-buoyant, and has a length to suit the water depth and the columns may be installed in one or more pieces. If desired, the interior of the column 16 may contain equipment such as risers, umbilicals, conductors, sumps, caissons, air lines, grout lines, ballast lines, control lines, access ways, man ways, etc.

Figure 16:
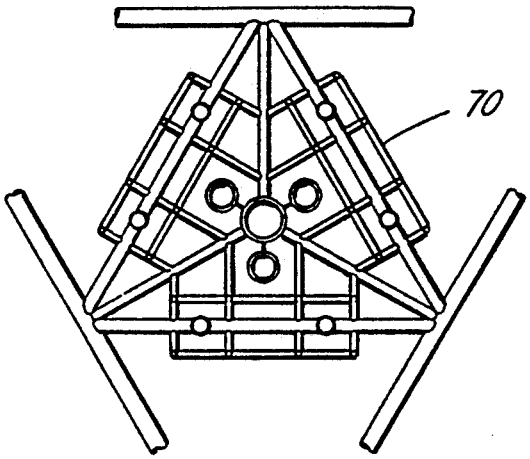
FIG. 16 is a fragmentary plan view illustrating a drilling/production template that may be used with the embodiment of FIGS. 12-15.
Figure 15:
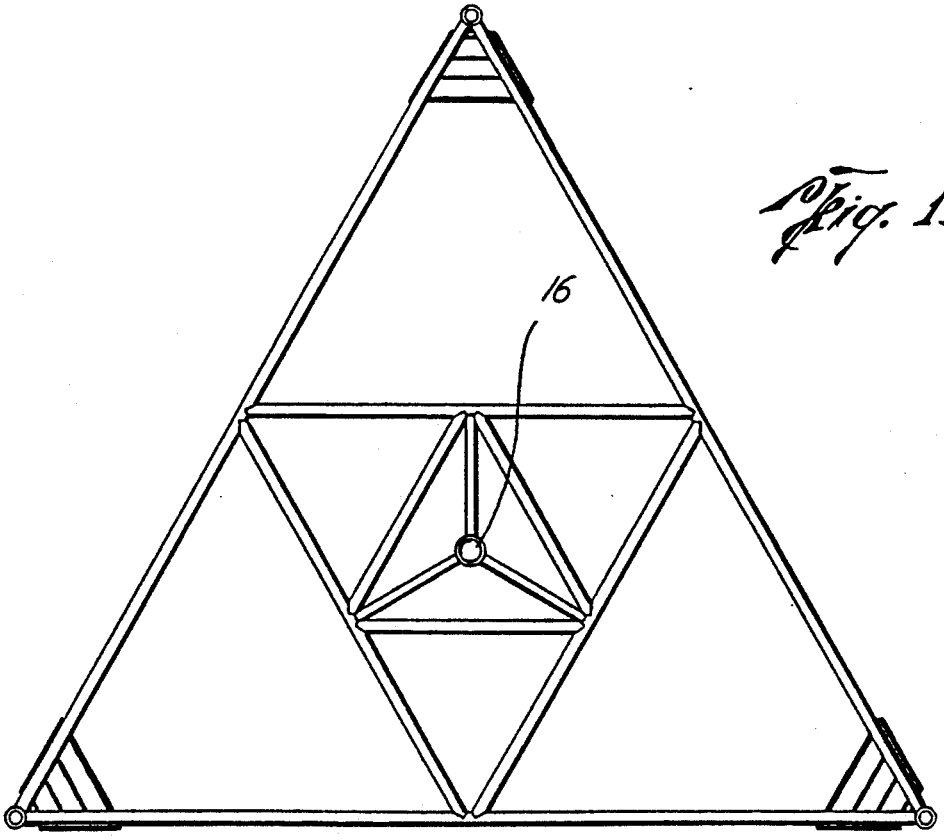
FIG. 15 is a cross-sectional view taken along the line 15—15 of FIG. 13.

The column support base 30 is a structural framework, constructed typically of steel tubular members which provide the lateral, but not the vertical support for the column 16. In the preferred embodiment of FIGS. 1–11, the base is triangular having legs 36, an upper column support 40, one or more intermediate column supports 42 (FIG. 2) intermediate bracing 44, mud line bracing 46 (FIG. 4), column support base anchors 48, and if desired drilling and production templates such as a drilling template 50 having conductor guides 52 (FIG. 5), or a drilling/production template 70 (FIG. 16).

The anchors 48 are typically a piled foundation which may include vertical piles 48 (FIG. 9) consisting of one or more piles installed through guides 49 located at the corners of the column support base, or at intermediate points if appropriate, or inclined as shown by pile 48*a* in guide 49*a* (FIG. 10) or may consist of a gravity base 48*b* (FIG. 11).

Figure 7:
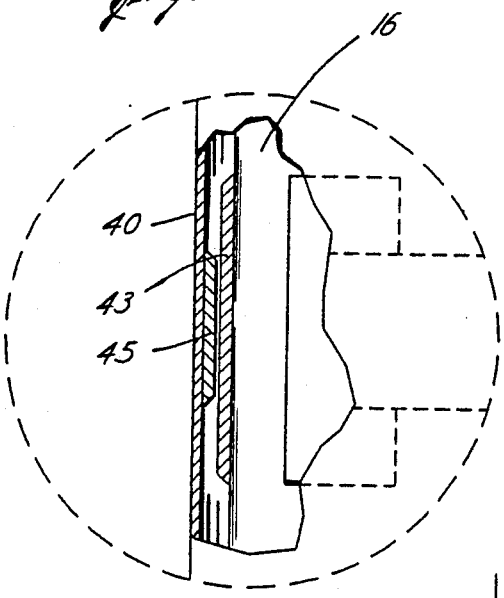
FIG. 7 is an enlarged fragmentary cross-sectional view illustrating the bearing support of FIG. 6.
Figure 7:
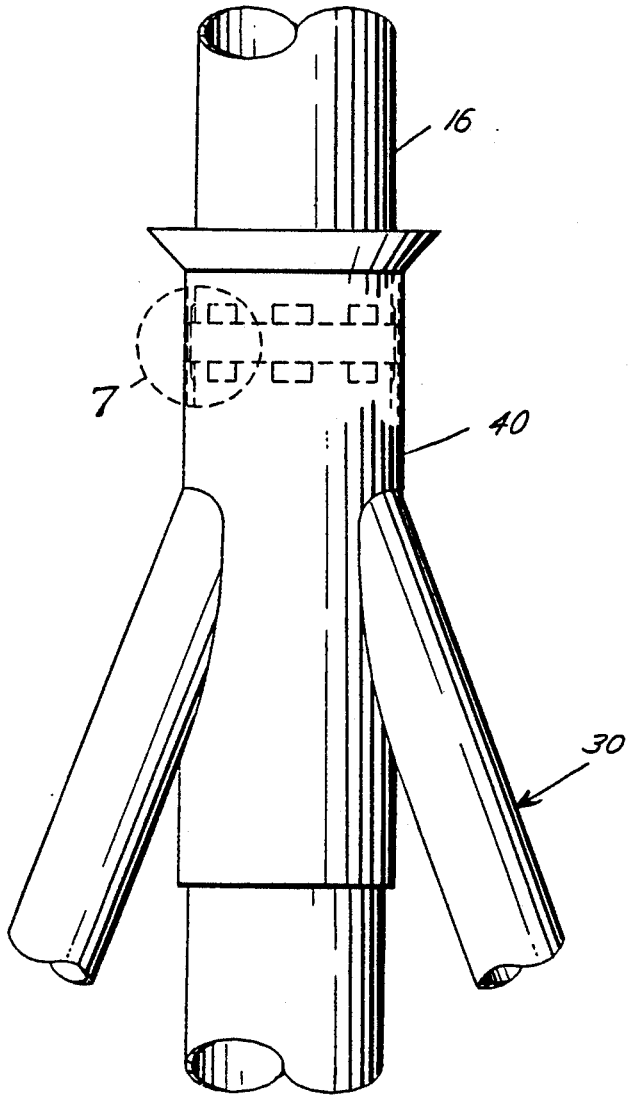
Figure 6:
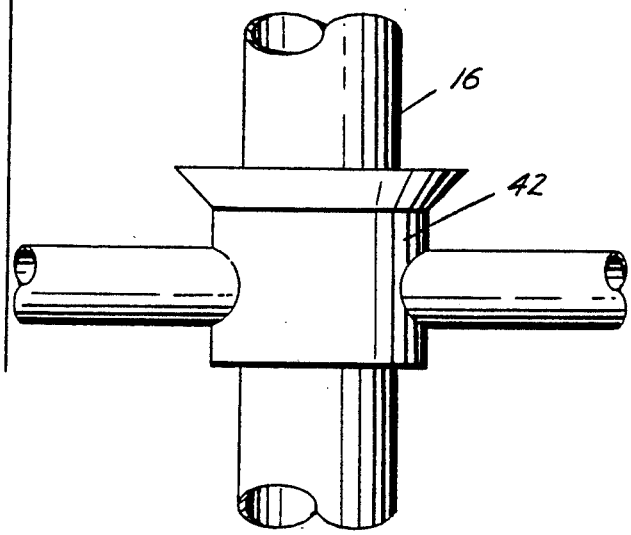
FIG. 6 is an enlarged fragmentary elevational view of the connection of the column and column support base of FIGS. 1-4.

In the preferred embodiment, as best seen in FIG. 6, the upper column support 40 and the intermediate column support 42 are preferably closed sleeves through which the column 16 is slidably inserted after the base 30 has been anchored to the offshore floor 12. As best seen in FIG. 7 lateral bearing between the column support base 30 and the column supports 40 and 42 may be provided by a bearing ring 45 on one of the members such as the inside of the upper column support 40 and a shim plate 43 on the other member such as the exterior of the column 16.

Referring now to FIG. 25, the plan view of a typical column support 40*a* is best seen which shows the support as an enclosed sleeve. However, other embodiments may be provided such as an open sided sleeves 40*b* and 40*d* as best seen in FIGS. 26, 28 and 29, or a hinged clamp best seen as in FIG. 27 as 40*c*. The embodiments 40*b*, 40*c* and 40*d* are particularly useful in the case where the column 16 has a length too long to be lifted end wise above the water line 14 for lowering down through the enclosed sleeve type 40*a*. In the column supports 40*b*, 40*c* and 40*d* the column 16 may be lowered into the water with its foot 20 positioned on the column foundation 22 and the column 16 swung sideways into the column supports 40*b*, 40*c* and 40*d* and retainers 41*b*, 41*c* and 41*d*, respectively, closed on the column 16, allowing it to be locked in place and laterally supported. In the case of the open sided sleeves 40*b* and 40*d* which may have a circumference greater than 180°, spacers 47 are provided for laterally supporting the column 16 in place after closure.

Figure 8:
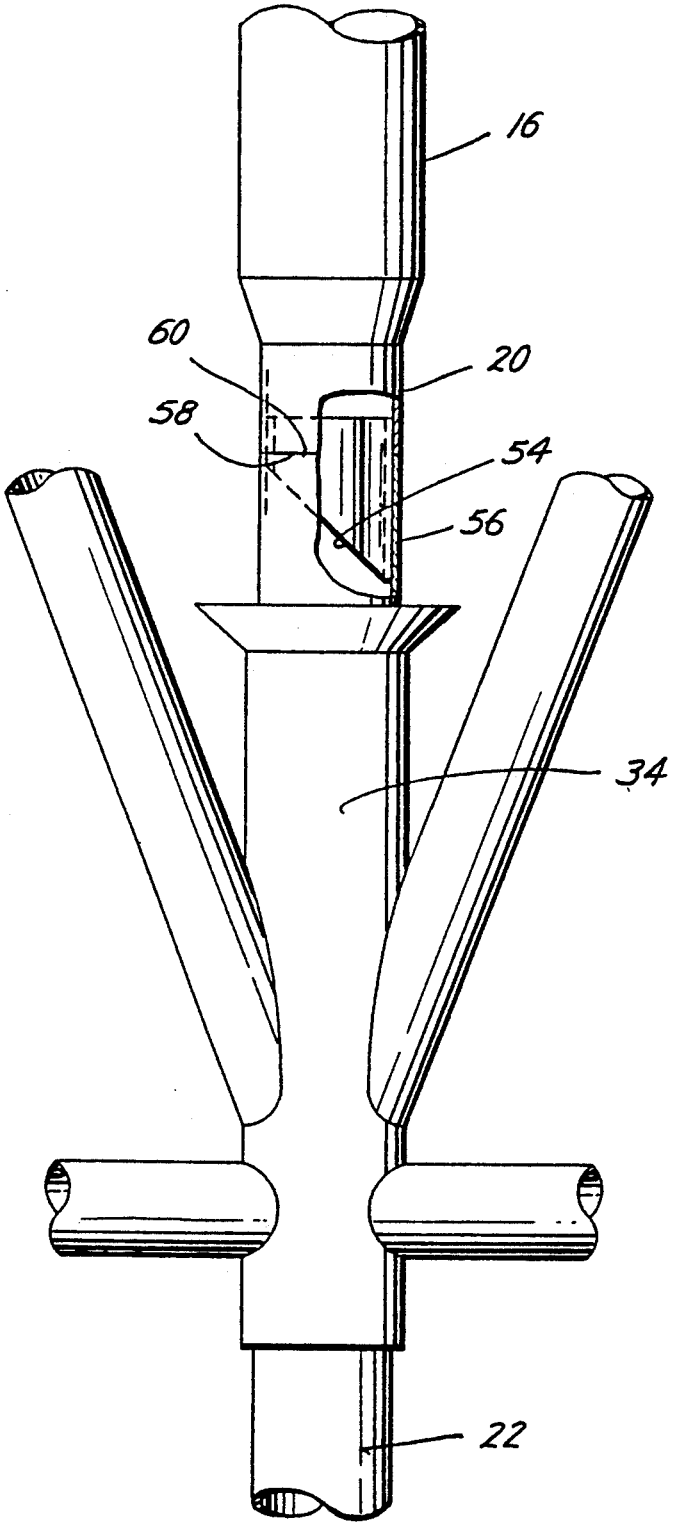
FIG. 8 is an enlarged fragmentary elevational view, partly in cross-section, illustrating one type of releasable connection between the column and the column foundation of the structure of FIGS. 1-7.
Figure 12:
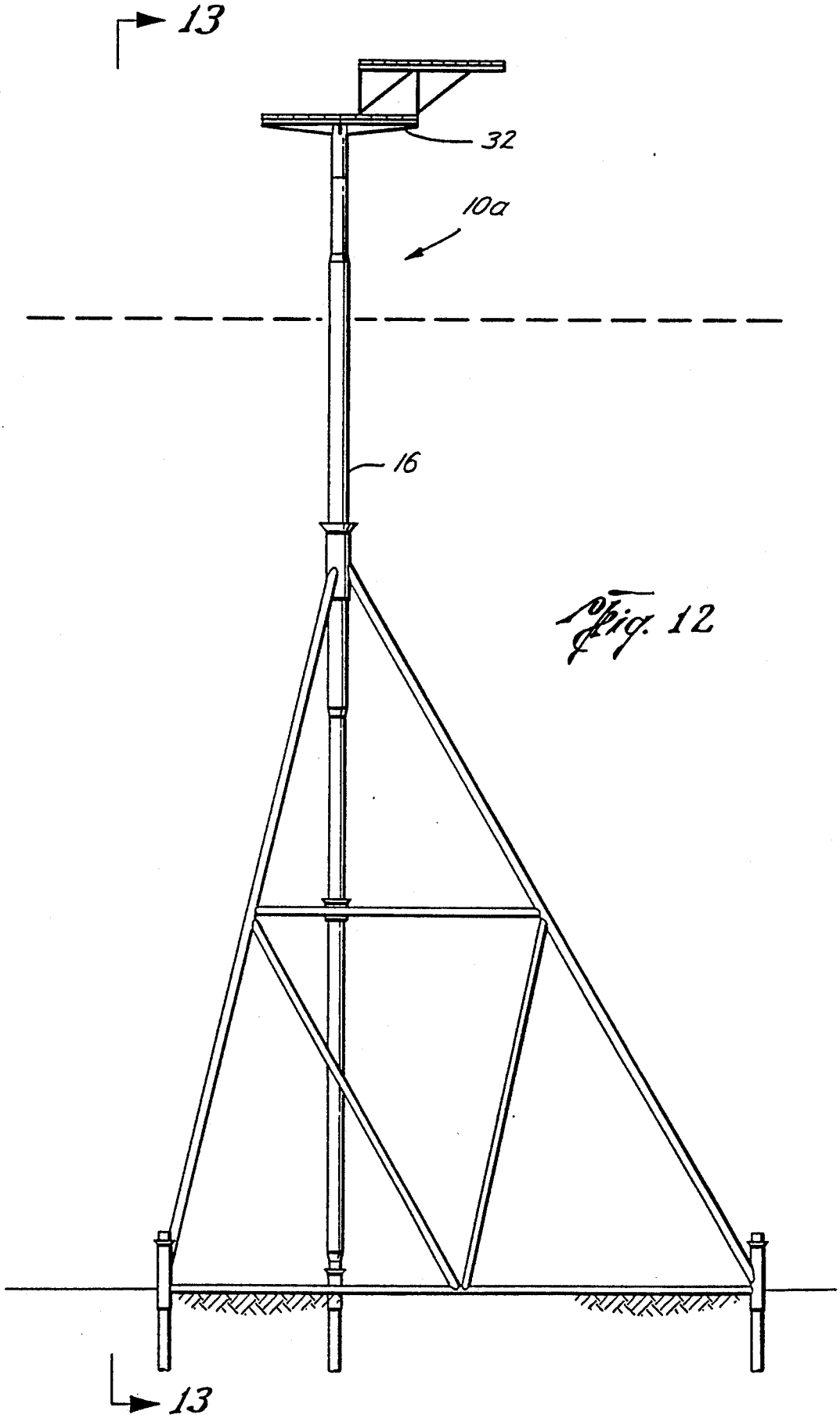
FIG. 12 is an elevational view of another embodiment of the offshore structure of the present invention.
Figure 13:
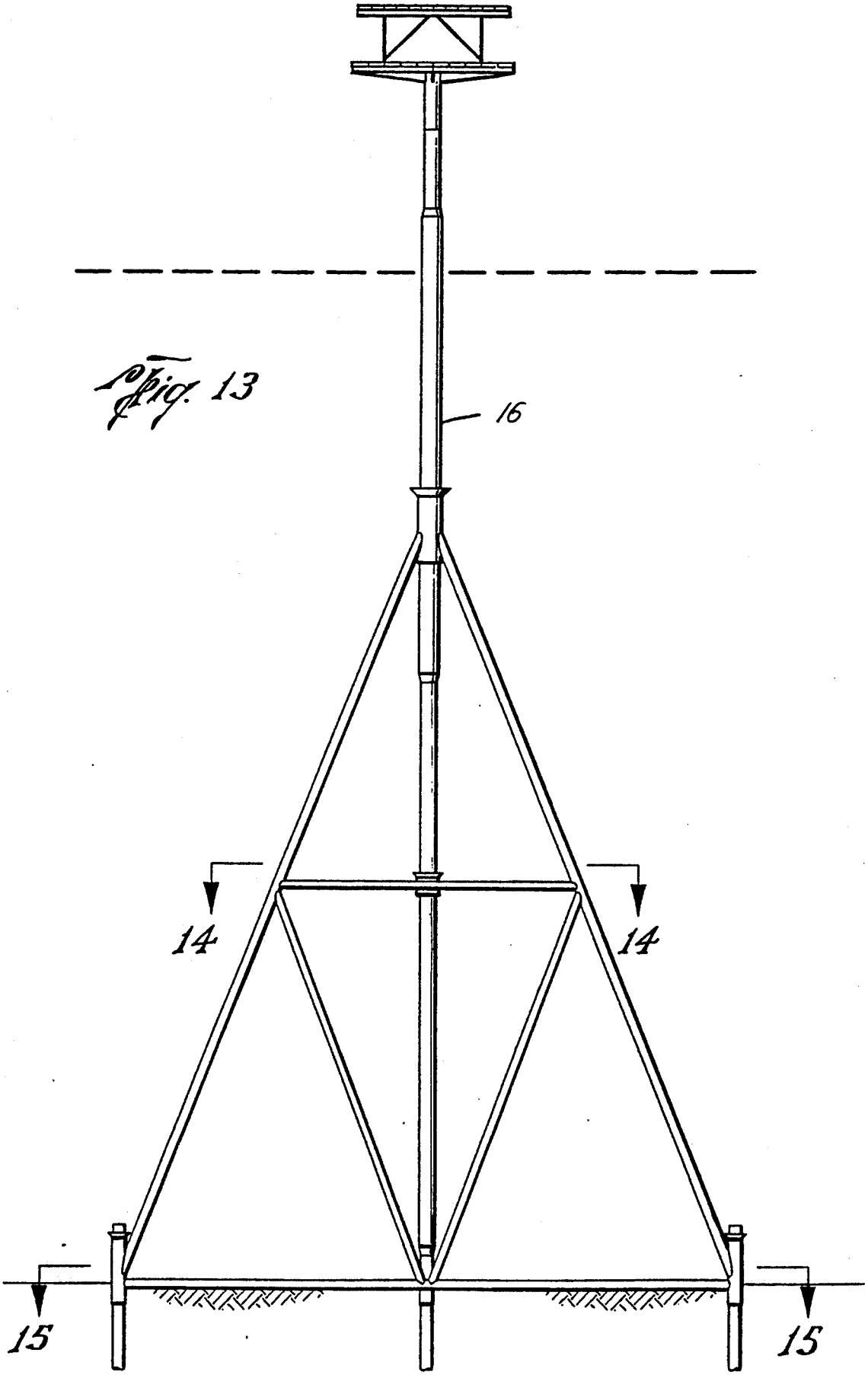
FIG. 13 is a view taken along the line 13—13 of FIG. 12.
Figure 14:
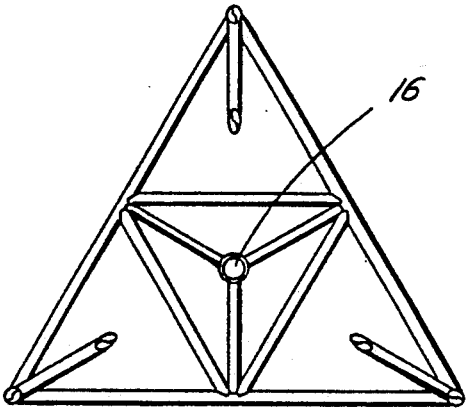
FIG. 14 is a cross-sectional view taken along the line 14—14 of FIG. 13.
Figure 23:
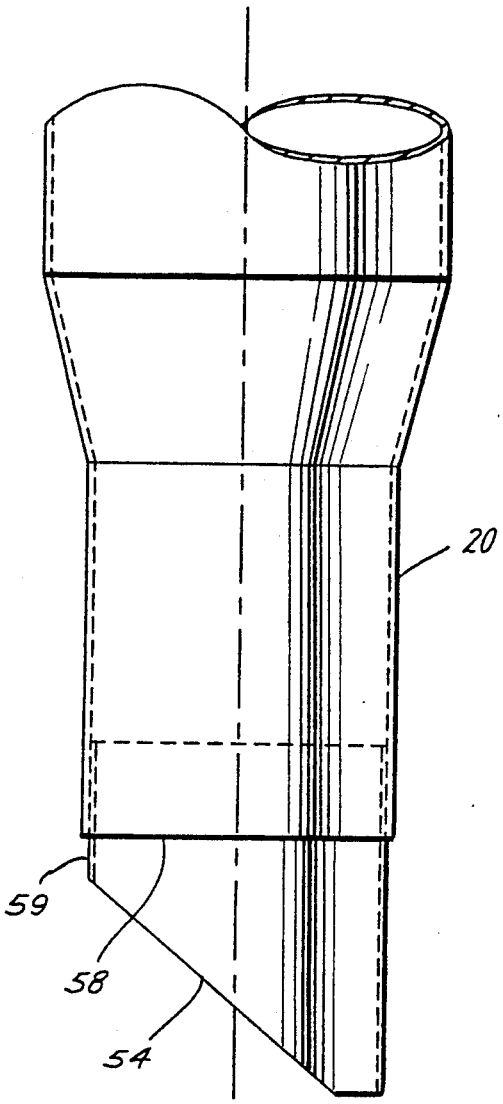
FIG. 23 is an enlarged fragmentary elevational view illustrating one type of foot for a column.
Figure 24:
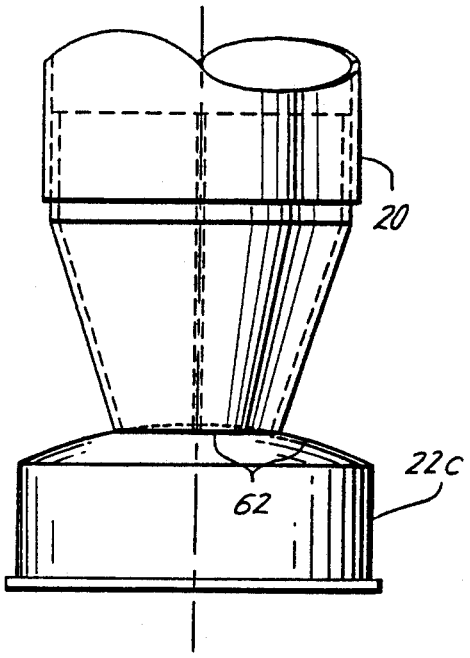
FIG. 24 is an enlarged fragmentary elevational view of another embodiment of a column foot.

As previously described, the column foot 20 releasably engages the column foundation 22 for providing support for all of the vertical loads in the column 16. That is, the vertical loads are transferred from the column 16 to their respective foundations 22 from the bearing surface 58 on the foot 20 of the column 16 to the bearing surface 60 on the foundation 22. The column foot 20 is the structure for transferring column axial and shear loads from the column 16 to the column foundation 22. In addition, the foot 20 is adapted to be releasably engaged and supported from the foundation 22. Referring now to FIGS. 8 and 23 the foot 20 may include a bearing surface 58 which is guided into position with a stabbing guide. Thus, the foot 20 includes a stabbing guide such as an inclined surface 54 for guiding the lower end of the foot into the upper end 56 of the column foundation 22. Co-acting bearing surfaces 58 and 59 on foot 20 and 60 on column foundation 22 are provided between the foot 20 and the upper end 56, respectively of the foundation 22. Thus, the interconnection of the foot 20 with the foundation 22 provides a releasable connection which provides vertical and lateral bearing support. Referring now to FIG. 24, as an alternative, an articulated joint may be provided at the foot 20 having co-acting ball surfaces 62 which provide rotational flexibility between the column foot 20 and the foundation 22*c*. That is, rotational flexibility is provided between the column 20 and the foundation 22. The upfacing surface 62 of the foundation 22*c* is a ball surface or spherical surface for supporting the column foot 20 which is a tubular member.

Of course, other types of feet may be used such as 20*a*, 20*b*, and 20*e*, shown in FIGS. 18, 19 and 22, respectively.

The support structure such as equipment deck 32 may be any suitable platform or device installed on the column 16 above the water level 14 and wave zone to support the necessary equipment or structures for intended operations. The support structure 32 may include a ballast control system for equalizing the distribution of loads on the structure 10 thereby reducing the adverse effects of loadings eccentric to the column 16.

In the embodiment of the structure 10 shown in FIGS. 1–11, a triangular base is shown in which the column 16 extends through one side of the mud line bracing system 46 and is thus on the outer periphery of the base. This particular structure 10 is advantageous for use with jack-up rigs which allows the column 16 to be closely adjacent to the drilling.

However, as best seen in FIGS. 12–15 a symmetrical tripod structure 10*a* is utilized wherein this structure is advantageous for use where drilling with a jack-up rig is not required. Drilling may be accomplished with a semi-submersible drilling rig, prior to installation of the support structure 32, or with drilling equipment installed on the support structure. If desired, a suitable drilling/production template 70 may be provided as best seen in FIG. 16.

Referring now to FIGS. 30, 31 and 32 a structure 10*b* is shown in which the column 16*h* is supported outside of the mud line bracing system 46*b*.

Referring now to FIGS. 33, 34 and 35 a structure 10*c* is shown which utilizes multiple columns such as two columns 16*i* and 16*j* in a tetrapod structure.

Figure 39:
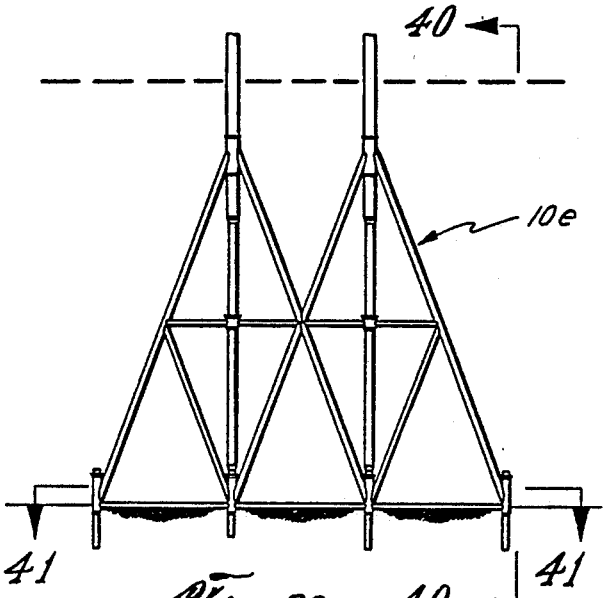
FIG. 39 is a fragmentary elevational view with still a further embodiment of an offshore structure of the present invention, utilizing multiple columns.
Figure 40:
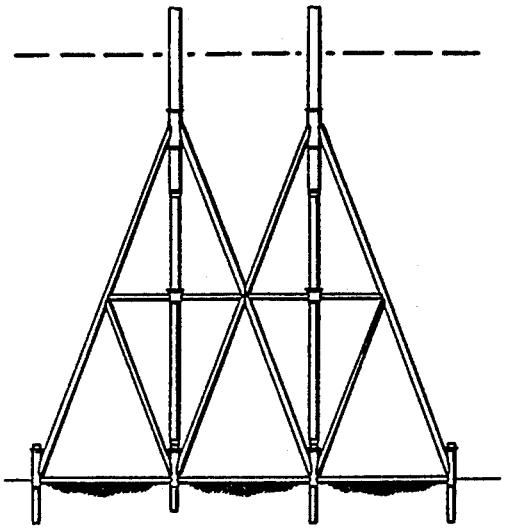
FIG. 40 is a view taken along the line 40—40 of FIG. 39.
Figure 41:
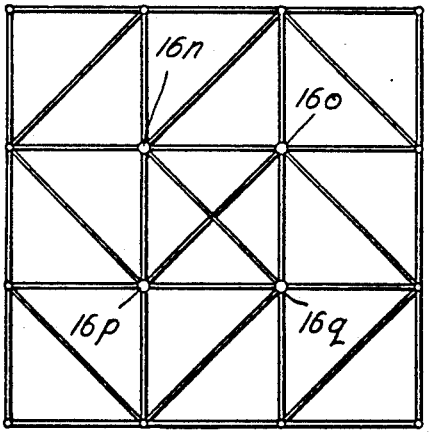
FIG. 41 is a cross-sectional view taken along the line 41—41 of FIG. 39.

And referring now to FIGS. 36, 37 and 38 another alternate embodiment is shown in which a plurality of columns 16*k*, 16*l* and 16*m* are provided in a structure 10*d* forming a three support column symmetrical tripod. Still a further embodiment of the invention is best seen in FIGS. 39, 40 and 41 in which a structure 10*e* is provided with four columns 16*n*, 16*o*, 16*p* and 16*q* in a four-column tetrapod.

The present invention provides a light weight structure which is achieved through the use of effective and efficient load paths for transferring all of the vertical loads from the columns to their respective foundations. That is, vertical loads are carried by the most direct route possible, that is directly downwardly through the column and into the column foundation. Lateral loads are transferred from the column to the column support base primarily by means of the upper column support and then through the legs of the column support base directly to the column support base anchoring system. Because the column is an extremely efficient load carrying element, it is capable of supporting a great deal of load with a relatively modest amount of material. While the maximum water depth for which this structure may be used is presently unknown, there appears to be no technical reasons why the structure of this invention cannot be designed for water depths in excess of 1,000 feet. In addition, the column support base is designed to be, if desired, a subsea template, thereby avoiding the need to remove the template prior to the installation of the production platform or to design the production platform to accommodate subsea templates.

In addition, the present invention may be installed by conventional, readily available construction equipment. By the use of the present design which minimizes the number of framing members, the present structure lends itself to ease of relocation and reuse at a variety of sites. Nominal variations in water depths may be accommodated by simply extending or shortening the column.

A typical sequence of operations for the offshore installation of the structure 10 might consist of (1) transporting the column support base 30, the column 16 and the support structure 32 to the site, (2) setting the column support base 30 on the offshore floor 12 in a conventional manner such as by either lifting or launching methods, (3) anchoring the column support base 30 by means of the anchors 48, (4) installing the column foundation 22, (5) if desired drilling any wells or this could be done subsequent to the completion of the platform, (6) completing any wells or this could be done subsequent to the installation completion, (7) installing the column 16 or columns, and (8) installing the support structure 32.

Because the column 16 is slidably installed through the column supports 40 and 42 and releasably engages the column foundation 22, the structure can be easily removed and relocated and used at other locations.

The present invention, therefore, is well adapted to carry out the objects and attain the ends and advantages mentioned as well as others inherent therein. While presently preferred embodiments of the invention have been given for the purpose of disclosure, numerous changes in the details of construction, type of materials, arrangement of parts, and steps of the process, may be made without departing from the spirit of the invention and the scope of the appended claims.

What is claimed is:

1. An offshore base-supported column structure for installation in the water on an offshore floor comprising, a column foundation supported from the offshore floor, an elongate column having a top and a foot, said foot contacting and vertically supported entirely by the column foundation, and said foot being releasably engaged to the foundation, said top extending upwardly above the offshore water level, a column support base supported from the offshore floor for engaging and providing lateral support for the column, said base including a structural framework extending upwardly from the floor to an intermediate portion of the column and the top of the base having a column support slidably engaging the column in the vertical direction against lateral movement, and a support structure connected to the top of the column above the water level.

2. The structure of claim 1 including a column foundation guide connected to the column support base for receiving and guiding the column foundation.

3. The structure of claim 1 including a releasable connection between the foot and said foundation for transferring column axial and shear loads from the column to the foundation.

4. The structure of claim 1 including one or more intermediate column supports connected to the column support base and slidably engaging the column for providing additional lateral support.

5. The structure of claim 1 wherein the column support includes an enclosed sleeve.

6. The structure of claim 1 wherein the column support includes a hinged clamp.

7. The structure of claim 1 wherein the column support includes an open sided sleeve for receiving the column.

8. The structure of claim 7 including spacers for releasably locking the column in the open sided sleeve.

9. The structure of claim 1 including a bearing ring between the column and the column support.

10. The structure of claim 1 wherein the column support base includes a triangular base and said column extends through one side of the base.

11. The structure of claim 1 wherein the column support base includes a mud line bracing system and the column extends vertically outside of the mud line bracing system.

12. The structure of claim 1 including a plurality of columns each of which is releasably supported from a column foundation and all of said columns freely extend vertically through and are laterally supported by the column support base.

13. The method of setting an offshore base-supported column structure comprising, setting a column support base having a column support on the offshore floor with the column support positioned at the top of the base and above the offshore floor, anchoring the column support base to the offshore floor, installing a column foundation in the offshore floor below the column support, installing the column by releasably engaging the bottom of the column to the column foundation and extending the top of the column above the offshore water level and supporting the entire vertical load of the column from the foundation, laterally supporting the column by the column support without providing vertical support, and installing a support structure to the top of the column above the water level.

14. The method of claim 13 including, guiding the installation of the column foundation through guides attached to the column support base.

15. The method of claim 13 including slidably installing the column through the column support. h

* * * * *

UNITED STATES PATENT OFFICE

CERTIFICATE OF CORRECTION

Patent No. 5,332,336 Dated July 26, 1994

Inventor(s) Roger F. Lewis

It is certified that error appears in the above-identified patent and that said Letters Patent is hereby corrected as shown below:

Column 8, line 61, after "support." delete -- h --

Signed and Sealed this

Eighteenth Day of April, 1995

Bruce Lehman

*Attest:*

BRUCE LEHMAN

*Commissioner of Patents and Trademarks*

*Attesting Officer*